United States Patent [19]

White

[11] 3,980,193

[45] Sept. 14, 1976

[54] CHILD-RESISTANT CONTAINER

[75] Inventor: David Leslie White, Richmond, England

[73] Assignee: C.R.C. Packaging Limited, London, England

[22] Filed: Dec. 9, 1975

[21] Appl. No.: 639,143

[52] U.S. Cl. ..... 215/205; 215/2; 215/211; 206/1.5

[51] Int. Cl.[2] ..... B65D 55/02; B65D 85/56

[58] Field of Search ..... 215/2, 9, 205, 211; 206/1.5

[56] References Cited

UNITED STATES PATENTS 3,393,815 7/1968 Turecek ..... 215/205 X 3,578,193 5/1971 Steiner ..... 215/211 X

*Primary Examiner*—George T. Hall

*Attorney, Agent, or Firm*—Ladas, Parry, Von Gehr, Goldsmith & Deschamps

[57] ABSTRACT

A container for pharmaceutical products has an un-removable dummy cap formation at one end, and an insert received in the other end, the insert having a hollow portion for receiving the end of an adult's finger so that the insert may be removed by deformation by digital pressure. The insert is so constructed as to be un-removable by a small child, who will in any case attempt unsuccessfully to remove the dummy cap rather than the insert.

6 Claims, 2 Drawing Figures

CHILD-RESISTANT CONTAINER

The present invention relates to containers and relates particularly to child-resistant containers for pharmaceutical products such as pills, tablets or capsules.

Every year many thousands of children under five are admitted to hospitals as a result of accidental poisoning caused by their opening containers such as bottles of pills and ingesting the contents.

It is an object of the present invention to provide a container which will resist the attempts of a young child to open it.

According to the present invention there is provided a container comprising a hollow tubular member having an opening at one end and an un-removable cap formation at the other end, and an insert of resilient material having a hollow portion, open at one end and tapering towards a closed other end, for receiving the distal phalanx of an adult's finger, the insert being adapted to be tightly held in and to achieve an air-tight fit with the hollow tubular member when inserted therein and being removable therefrom by deformation by digital pressure.

Figure 1:
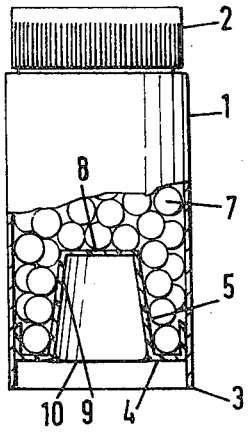
Figure 2:
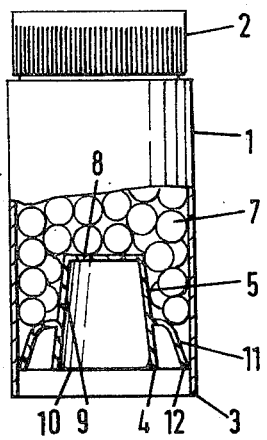

The present invention will now be more fully described by way of example with reference to the accompanying drawings, wherein:

FIG. 1 is a part-sectional view of a first embodiment of a container according to the present invention, and FIG. 2 is a part-sectional view of a second embodiment of a container according to the present invention.

In the first embodiment a container comprises a hollow tubular member 1 having one of its ends 2 shaped to resemble a conventional opening cap. The other end 3 of the hollow tubular member 1 is open.

An insert 4 of flexible material such as plastics or rubber has an approximately thimble-shaped inwardly tapering hollow portion 5. At its open end it is provided with an exterior annular flange portion 6. The contacting surfaces of the flange portion 6 and the hollow tubular member 1 are dimensioned to ensure an air-tight fit of the insert 4 in the hollow tubular member 1. The hollow porton 5 of the insert 4 is of a size sufficient to receive at least the leading portion of the distal phalanx of an adult's finger.

In this embodiment the hollow tubular member 1 and the insert 4 are of circular cross-section. The internal diameter of the hollow tubular member 1 and the exterior diameter of the annular flange 6 are both 26mm, the interior diameter of the hollow portion 5 of the insert at its open end is 17mm, and its internal diameter at its inner closed end is 14mm. The depth of the hollow portion is 20mm. The dummy cap 2 has a smaller diameter than the inner diameter of the hollow tubular member to enable the dummy cap 2 to be inserted in the end portion of the hollow tubular member 1 of an other container to facilitate stacking of containers.

A membrane 10 is provided over the open end of the hollow portion of the insert 4, providing an anti-pilfering feature prior to the container being sold or dispensed to a user. The membrane is easily rupturable by digital pressure.

In operation the hollow tubular member 1 is filled with pills, tablets or capsules 7 to a required level and the insert is inserted until its inner end 8 presses against the pills, tablets or capsules 7. In this way the container is rendered noiseless, and thus no noise attraction is provided for a young child to use it as a plaything. The amount of pills, tablets or capsules will usually be such that the open end of the insert is inserted a little way along the inner tubular member, thus enabling the container to be conveniently stacked, as described above.

To open the container the distal phalanx of an adult's finger is inserted, rupturing the membrane 10 on first use, into the hollow portion of the insert 4. Digital pressure against the lateral wall 9 of the insert will produce a deformation of the insert and thus allow it to be drawn against suction created by the air-tight fit of the insert by digital pressure from the hollow tubular member to permit access to the container's contents. As the number of pills, tablets or capsules is reduced the insert can be more deeply inserted into the hollow tubular member, retaining the noiseless feature of the container.

When a young child attempts to open the container his attention will initially focus on the dummy cap 2. After a number of fruitless attempts to open the container by removing the cap he may give up. Even if he does attempt to withdraw the insert he will be unable to do so since the hollow portion of the insert 4 may be too deep in the tubular member 1 for his fingers to reach, and even if this is not the case he will lack the strength and co-ordination to deform the insert and withdraw the deformed insert against suction from the tubular member. He will also lack the mental co-ordination to appreciate what is required to open the container, whether by reading the instructions or otherwise.

In the second embodiment illustrated in FIG. 2 the insert 4 is of a different construction. The laterall wall 9 is substantially h-shaped in cross-section, the outer arm 11 of the h-shaped portion being outwardly inclined. In its free position outside the hollow tubular member 1 the external diameter of the outer arm 11 at its open end portion 12 is greater than the internal diameter of the hollow tubular member 1, whereby when the insert 4 is inserted into the hollow tubular member the open end portion 12 of the outer arm 11 is urged against the internal surface of the hollow tubular member 1 to provide an air-tight fit of the insert 4 in the hollow tubular member 1.

As the insert 4 can be pushed into the hollow tubular portion until it contacts the pills, tablets or capsules there is no need for the cotton wool or the like padding as used in conventional containers.

The hollow tubular member need not be circular in cross-section and may vary in size. In such circumstances the cross-sectional shape and dimensions of the insert would be altered accordingly.

The periphery of the open end 3 of the tubular member 1 may be provided with a serrated edge, which will not inconvenience an adult when opening the container, but will deter a child from inserting his fingers into the end 3.

As an additional safety feature, the top of the dummy cap may be made of convex shape or provided with a domed protrusion, whereby the container may only be placed on a flat surface on its side or with its open end 3 lowermost. Thus, if an adult does not replace the insert 4 after use, the contents of the container will spill out when it is put down, thus effectively eliminating the possibility of the adult forgetting to replace the insert.

The dummy cap 2 may also be made rotatable with respect to the tubular member 1, whilst still being unremovable, in order to keep a child's attention directed to the dummy cap rather than the other end in which insert is received.

I claim:

1. A container comprising a hollow tubular member having an opening at one end and an un-removable cap formation at the other end, and an insert of resilient material having a hollow portion, open at one end and tapering towards a closed other end, for receiving the distal phalanx of an adult's finger, the insert being adapted to be tightly held in and to achieve an air-tight fit with the hollow tubular member when inserted therein and being removable therefrom by deformation by digital pressure.

2. A container as claimed in claim 1 wherein the insert has an outer flange at its open end, the external surface of said flange being dimensioned to contact the internal surface of the hollow tubular member, thereby ensuring an air-tight fit when the insert is inserted into the hollow tubular member.

3. A container as claimed in claim 1 wherein the insert has an outwardly projecting annular portion at its open end, the maximum external diameter of said annular portion being greater than the internal diameter of the hollow tubular member when the insert is outside the hollow tubular member, whereby the insert may be inserted in the hollow tubular member and held under tension in the hollow tubular member to ensure an air-tight fit.

4. A container as claimed in claim 1 wherein a membrane rupturable by digital pressure is provided across the open end of the hollow portion of the insert.

5. A container as claimed in claim 1 wherein the external diameter of the unremovable cap formation is less than the internal diameter of the hollow tubular member whereby the cap can be inserted into the hollow tubular member of an adjacent like container and the hollow tubular member can receive the cap of an adjacent like container.

6. A container as claimed in claim 1 wherein the internal diameter of the hollow portion of the insert at its open end is substantially 17mm and the internal diameter of said hollow portion at its closed end is substantially 14mm, the depth of said hollow portion being substantially 20mm.

* * * * *